United States Patent [19]

Matthews et al.

[11] Patent Number: 5,007,221

[45] Date of Patent: Apr. 16, 1991

[54] SNAP-IN GLAZING POCKET FILLER

[75] Inventors: Thomas E. Matthews, Lilburn; Charles P. Touton, Roswell, both of Ga.

[73] Assignee: Kawneer Company, Inc., Norcross, Ga.

[21] Appl. No.: 484,171

[22] Filed: Feb. 23, 1990

[51] Int. Cl.[5] ..... E04C 3/00; E04D 1/36

[52] U.S. Cl. ..... 52/464; 52/466; 52/468

[58] Field of Search ..... 52/235, 464, 465–469, 52/731, 732; 49/DIG. 1, DIG. 2

[56] References Cited

U.S. PATENT DOCUMENTS

| | | | |
|---|---|---|---|
| 2,822,898 | 2/1958 | Richards | 52/464 |
| 2,866,527 | 12/1958 | Schilling | 52/466 |
| 3,732,659 | 5/1973 | LaBarge | 52/464 |
| 3,760,544 | 9/1973 | Hawes | 52/468 |
| 4,062,161 | 12/1977 | Schubach | 52/468 |

FOREIGN PATENT DOCUMENTS

| | | | |
|---|---|---|---|
| 2013267 | 8/1979 | United Kingdom | 49/DIG. 2 |

*Primary Examiner*—Neill R. Wilson

*Attorney, Agent, or Firm*—Jones, Askew & Lunsford

[57] ABSTRACT

A snap-in glazing pocket filler is disclosed for use with a structural frame member having an unused glazing pocket. The glazing pocket filler includes an elongated metal plate having front and rear faces and being dimensioned to cover said glazing pocket. A pair of plastic retaining legs are fastened to the elongated metal plate and extend rearwardly and outwardly thereof to engage the walls of the glazing pocket. In one aspect of the invention, the plastic retaining legs are pivotably fastened to the metal plate such that when the glazing pocket filler is snapped into the glazing pocket, the legs pivot outwardly to facilitate engagement of the legs with the pocket walls. In the disclosed embodiment, the plastic retaining legs comprise rigid stems having flexible barbs projecting outwardly therefrom to engage the pocket walls. The flexible barbs and rigid stems are coextruded of flexible and rigid polyvinyl chloride.

11 Claims, 2 Drawing Sheets

SNAP-IN GLAZING POCKET FILLER

TECHNICAL FIELD

The present invention relates generally to structural framing systems, and relates more specifically to a filler plate for covering an unoccupied glazing pocket in a structural frame member where the glazing pocket is not used to receive a glazing panel.

BACKGROUND OF THE INVENTION

Structural framing systems are in widespread use. A conventional structural framing system comprises elongated structural members, typically of extruded aluminum construction, which have glazing pockets formed on their opposing faces. The glazing pockets are adapted to receive the lateral edge of a glazing panel, such as a window pane. The structural members will also typically define longitudinal channels within the glazing pocket for receiving the longitudinal edges of glazing gaskets.

In certain instances, one of the glazing pockets of a structural member may not be used, for example, where one side of the structural member defines a door opening. In such instances, it is desirable for both aesthetic and functional reasons to conceal the unused glazing pocket. Toward that end, a variety of filler plates have been empolyed for covering the empty glazing pocket.

Since glazing pocket fillers are employed in part for aesthetic reasons, it is desirable to provide a filler which can be fastened to the glazing pocket without the need for exposed fasteners. Glazing pocket fillers thus typcially fall into one of two categories: slide-in fillers or snap-in fillers. Both types of fillers comprise a cover plate having a pair of outwardly extending legs attached to its rear surface. The cover plate is dimensioned to span the glazing pocket, and the legs are configured to engage the structural member to retain the filler in place. The slide-in variety of glazing pocket filler typically has a pair of relatively short legs, and the filler is slid onto the structural member from one end before the framing system is erected. In one widely used configuration, a slide-in glazing pocket filler has legs which engage the gasket channels to retain the filler in place. Slide-in glazing pocket fillers suffer a number of disadvantages, however, the primary disadvantage being that the filler must be installed during the process of erecting the framing system. If the worker installing the framing system neglects to install the slide-in filler when the framing system is erected, or if the filler later becomes damaged and requires replacement, a slide-in filler plate cannot be installed once the framing system is erected.

The second variety of glazing pocket fillers, the snap-in glazing pocket filler, has relatively longer legs which permit the filler to be sanpped on to the structural member from the side. This arrangement presents certain advantages over the slide-in filler, in that the filler may be installed after the framing system has been erected. Despite this advantage, however, prior art snap-in glazing pocket fillers suffer certain disadvantages. Both the snap-in filler and the frame member must be manufactured with great precision for the filler to engage the frame member properly, and even minor variations of the frame member or filler within manufacturing tolerances may result in an improper fit, causing the filler to rattle or slide within the glazing pocket. There are a number of other causes of improper fit in addition to manufacturing tolerances. For example, anodizing an aluminum structural member will etch away material and thus reduce the dimensions of the extrusion. Conversely, if the member is painted, the additional layer(s) of material will increase the dimensions of the extrusions. Or, as the dies used in the extrusion manufacturing process begin to wear, the dimensions of the resulting extrusion will increase, which again affects tolerances and can result in an undependable fit of the glazing pocket filler.

Another problem which affects te fit of the filler within the glazing pocket concerns the elasticity of the extruded aluminum legs which engage the structural member to retain the filler in place. If the legs are bent beyond their elastic limit, that is, past their yield point, during the installation procedure, the legs will not spring back to their full extent. Legs which are thus deformed will not snugly grip the walls of the glazing pocket, leading to the aforementioned problems of the filler rattling and sliding within the glazing pocket. This problem is compounded in contermporary "narrow profile" frame members, wherein one of the glazing pocket is considerably shallower than in a full-width frame member. With the shallower glazing pocket, the legs of the glazing pocket filler must be correspondingly shorter. Since the distance by which the legs must deflect inwardly in order to snap into the glazing pocket remains unchanged in comparison to a full-width frame member, the shorter legs require a greater angular deflection, thus increasing the likelihood that the legs will be bent beyond their elastic limit and not fully return to their normal position to firmly engage the walls of the glazing pocket, with the disadvantages hereinabove enumerated.

Thus, there is a need to provide a glazing pocket filler which can be securely mounted to a framing system after erection without the need for exposed fasteners.

There is a further need for a snap-in glazing pocket filler which will provide a secure and dependable fit despite variations resulting from manufacturing tolerances.

There is still another need for a snap-in glazing pocket filler which can be installed without bending the legs past their elastic limit and thereby permanently deforming the legs and thereby adversely affecting the fit of the filler.

There is also a need for a snap-in glazing pocket filler which can provide a dependable fit in the shallow glazing pocket of a narrow profile frame member.

SUMMARY OF THE INVENTION

As will be seen, the present invention overcomes these and other problems associated with prior art glazing pocket filler. Stated generally, the present invention comprises a glazing pocket filler for covering unoccupied glazing pockets in structural framing systems. The filler of the present invention affords the advantages of snap-in installation, such that the glazing pocket filler may be installed either before or after the framing system is erected. The filler grips the walls of the glazing pocket snugly to prevent rattling and sliding within the pocket, yet is not affected by dimensional variations resulting from manufacturing tolerances. Further, the legs of the filler are not bent past their yield point during the installation process, even when installed in the shallow glazing pockets of narrow profile frame members, and therefore do not risk being permanently deformed. Thus, a snug fit is assured.

Stated somewhat more specifically, the present invention comprises a snap-in glazing pocket filler for use with a structural frame member having an unused glazing pocket. The glazing pocket filler includes an elongated metal plate having front and rear faces and being dimensioned to cover the glazing pocket. A pair of plastic retaining legs are fastened to the elongated metal plate and extend rearwardly and outwardly thereof to engage the walls of the glazing pocket. In one aspect of the invention, the plastic retaining legs are pivotably fastened to the metal plate such that when the glazing pocket filler is snapped into the glazing pocket, the legs pivot outwardly to facilitate engagement of the legs with the pocket walls. In the disclosed embodiment, the plastic retaining legs commprise rigid stems having flexible barbs projecting outwardly therefrom to engage the pocket walls. Also in the disclosed embodiment the plastic legs are of dual durometer construction achieved by coextruding the flexible barbs and rigid stems from flexible and rigid polyvinyl chloride.

Thus, it is an object of the present invention to provide an improved glazing pocket filler plate.

It is a further object of the present invention to provide a glazing pocket filler which provides the ease and convenience of snap-in installation while always providing a secure fit.

It is another object of the present invention to provide a snap-in glazing pocket filler which is suitable for use in the shallow glazing pocket of a narrow profile frame member.

Yet another object of the present invention is to provide a snap-in glazing pocket filler having legs which are not bent past their elastic limit during installation, whereby the glazing pocket filler will firmly engage the corresponding walls of the glazing pocket and not rattle or slide.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
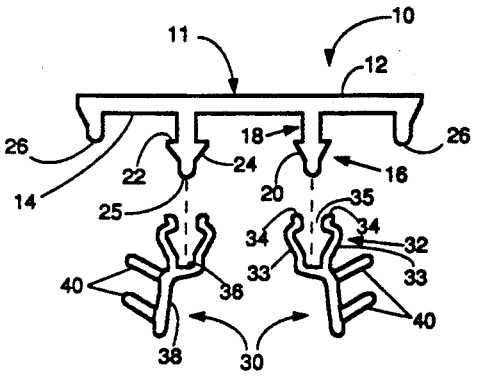
FIG. 1 is an exploded end view of a glazing pocket filler according to the present invention.

Referring now to the drawings in which like numerals refer to like elements throughout the several views, FIG. 1 shown a snap-in glazing pocket filler assembly 10 according to the present invention. The filler assembly 10 comprises a filler plate 11 having a front face 12 and an opposing rear face 14. A pair of flanges 16 protrude rearward from the rear face 14 of the filler plate 11. The flanges 16 include a narrow neck portion 18 and a tapered body portion 20. Each body portion 20 includes opposing shoulders 22 at its upper end and opposing outer faces 24 tapering inwardly from the shoulders 22 to a tip 25. In addition to the flanges 16, a pair of tabs 26 extend rearward from the rear face 14 of the filler plate 11, one tab from each end of the face plate. The purpose and configuration of the tabs 26 will be explained below. The filler plate 11 of the disclosed embodiment is an aluminum extrusion of indeterminate length which may be anodized, painted, or otherwise finished as the intended use dictates.

The snap-in glazing pocket filler assembly 10 further comprises a pair of legs 30. Each leg 30 includes a socket portion 32 comprised of opposing wall portions 33 having upper ends 34 defining an opening 35 therebetween. The socket portion 32 includes a socket base 36. Extending rearward from the socket portion 32 of each leg 30 is a stem element 38. A pair of barbs 40 project outwardly from each stem element 38. Preferably, the barbs 40 are comprised of a soft, flexible material, while the remainder of the legs 30 are comprised of a somewhat more rigid material. In the disclosed embodiment, the legs 30 are comprised of polyvinyl chloride (PVC). More particularly, the barbs 40 are comprised of a flexible PVC, while the remaining elements of the legs 30 are comprised of rigid PVC, with the flexible and rigid components coextruded into a unitary structure. However, it will be appreciated that other suitable thermoplastic materials may also be used.

Figure 2:
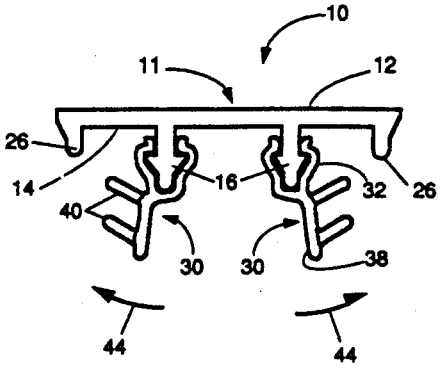
FIG. 2 is an assembled end view of the glazing pocket filler of FIG. 1.

FIG. 2 illustrates the assembly of the legs 30 onto the filler plates 11. The socket portion 32 of each leg is inserted onto a corresponding flange 16 with the tip 25 of the flange being received into the socket opening 35. As the socket 32 pushed onto the flange 16, the bevelled faces 24 of the body portion 20 of the flange force the upper ends 34 of the socket walls 33 outwardly. As the socket 32 is fully installed onto the flange 16, the upper ends 34 of the socket walls 33 pass the shoulders 22 and snap inwardly such that the upper ends of the socket walls engage the narrow neck portion 18 of the flange. In this postion, the tip 25 of the flange 16 bears against the socket base 36.

It will be noted that the interior dimensions of the socket 32 are such that the socket wall portions 33 are spaced apart from the body portion 20 of the flange 16 and do not snugly engage the face 24 of the body portion. In this manner, each leg 30 is mounted to its corresponding flange 16 so as to permit a certain degree of pivoting movement, as indicated by the arrows 44.

Figure 3:
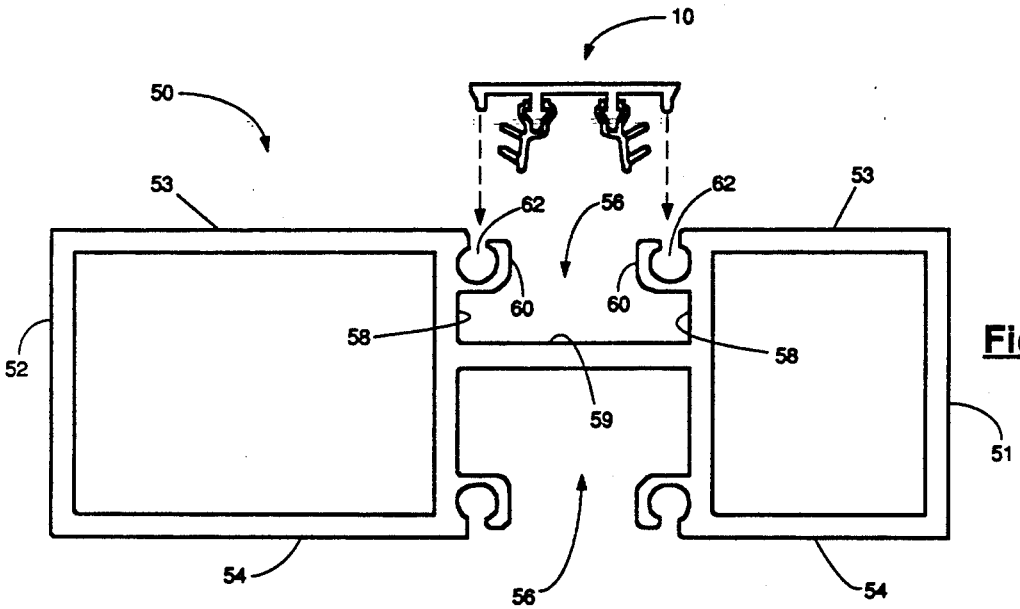
FIG. 3 is an end view of the glazing pocket filler of FIG. 1 illustrating how the filler is assembled onto a structural frame member
Figure 4:
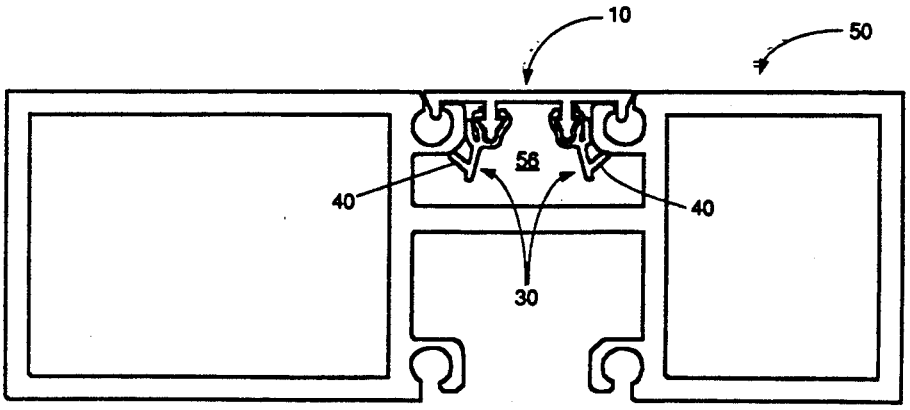
FIG. 4 is an end view of the glazing pocket filler and structural frame member of FIG. 3 showing the components assembled.

FIGS. 3 and 4 illustrate the mounting of the glazing pocket filler assembly 10 onto a structural frame member 50. The frame member 50 comprises a front face 51, a rear face 52, and opposing side walls 53, 54. A glazing pocket 56 is formed on each of the opposing side walls 53, 54. Each glazing pocket 56 comprises a pair of oposing side walls 58 and a bottom wall 59. The frame member 50 further includes walls 60 defining a pair of generally U-shaped gasket channels 62 defined within each of the glazing pocket 56.

Installation of the glazing pocket filler assembly 10 onto the frame member 50 will now be explained. The plastic legs 30 of the glazing pocket filler 10 are inserted into the glazing pocket 56. The barbs 40 projecting outwardly from each leg 30 engage the walls 60 defining the gasket channels 62, flexing to accomodate insertion of the legs into the glazing pocket 56. As shown in FIG. 3, the tabs 26 on the ends of the filler plate 11 are spaced apart by a distance corresponding to the spacing between the gasket channels 62 in the glazing pocket 56. The tabs 26 are configured to be received within the gasket channels 62 and seve to position the glazing pocket filler assembly 10 with respect to the glazing pocket 56. The galzing pocket filler assembly 10 is fully inserted into the glazing pocket 56 until the tabs 26 on the ends of the filler plate 11 engage the gasket channels 56. The barbs 40 bear firmly against and behind the walls 60 defining the gasket channel 62 to retain the glazing pocket filler assembly 10 within the the glazing pocket 56.

The manufacture of the snap-in glazing pocket filler assembly 10 of the present invention will now be discussed. The filler plat 11 is extruded from a aluminum or the like in a conventional manner. The filler plate 11 can be anodized, painted, or otherwise finished as its intended use dictates. The plastic legs 30 are extruded from PVC or other appropriate material. The flexible PVC comprising the barbs 40 and the more rigid PVC material comprising the socket 32 and stem 38 are coextruded to form a unitary structure. The plastic legs 30 are now ready for assembly onto the filler plate 11.

Figure 5:
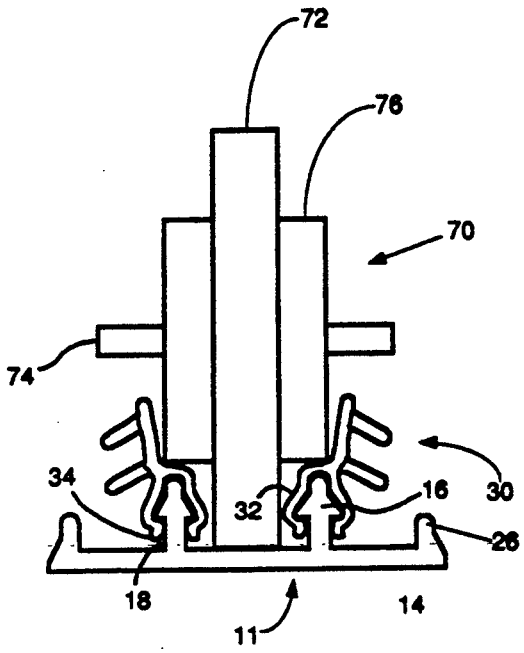
FIG. 5 is an end plan view of an apparatus for pressing plastic legs onto the flanges of a narrow filler plate.
Figure 6:
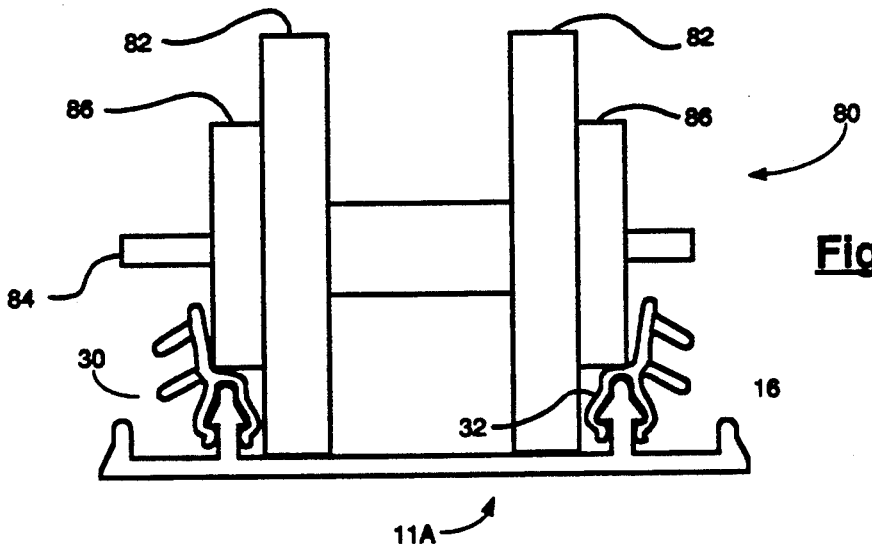
FIG. 6 is an end plan view of an apparatus for pressing plastic legs onto the flanges of a wider filler plate.
Figure 7:
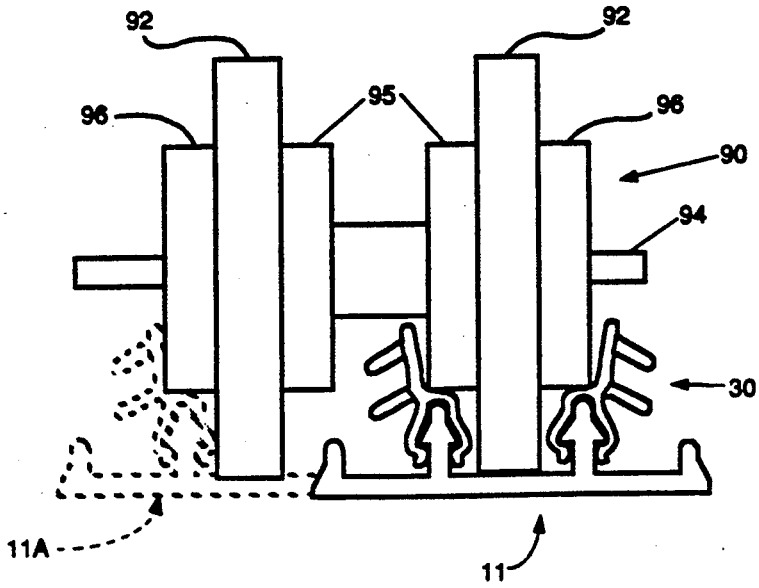
FIG. 7 is an end plan view of a combination apparatus suitable for pressing plastic legs onto the flanges of both a narrow filler plate and a wider filler plate.

FIGS. 5–7 depict apparatus for pressing the plastic legs 30 onto the flanges 16 of the filler plate 11. FIG. 5 shows a narrow press wheel 70 having a central guide portion 72 and being mounted for rotation on an axle 74. An opposing pair of reduced radius shoulders 76 are disposed one on either side of the central guide portion 72. The filler plate 11 is positioned with the flanges 16 directed upwardly, and the plastic legs 30 are positioned along the flanges. As the press wheel 70 is guided over the rear face 14 of the filler plate 11, the central guide portion 72 rides in the section between the flanges 16, and the shoulders 76 press the sockets 32 of the legs 30 down onto the flanges. As the socket 32 is pushed onto the flange 16, the bevelled faces 24 of the body portion 20 of the flange (FIG. 1) force the upper ends 34 of the socket walls 33 outwardly. As the socket 32 if fully pressed onto the flange 16, the upper ends 34 of the socket walls 33 pass the shoulders 22 and snap inwardly such that the upper ends of the socket walls engage the narrow neck portion 18 of the flange.

FIG. 6 depicts an apparatus for pressing the plastic legs 30 onto a wider filler plate 11A. The apparatus comprises a wide press roller 80 having a pair of spaced apart guide portions 82 mounted for rotation on a common axle 84. A shoulder portion 86 of reduced radius is disposed on the outwardly directed face 88 of each guide portion 82. The operation of the press roller 80 is identical to the operation of the press roller 70 previously described except that both guide portions 82 ride in the area between the flanges 16 of the filler plate 11.

FIG. 7 depicts an apparatus suitable for pressing the plastic legs 30 onto either a narrow filler plate 11 or a wide filler palte 11A. The apparatus comprises a wide press roller 90 having a pair of spaced apart guide portions 92 mounted for rotation on a common axle 94. Inner and outer reduced radius shoulder portions 95,96 respectively are disposed one on either side of each guide portion 92. When the press roller 90 is used for pressing plastic legs 30 onto a narrow filler plate 11, only one of the two guide portions 92 and its associated shoulders 95,96 are employed. When the press roller 90 is used for pressing plastic legs 30 onto a wide filler plate 11A (shown in dashed lines in FIG. 7), both guide portions 92 and their respective outer shoulder portions 96 are used to press the sockets 32 onto the respective flanges 16.

An important feature of the present invention is the provision of plastic legs 30 which can easily flex to accomodate insertion of the legs into the glazing pocket 56, and yet are sufficiently resilient that they are never bent past their yield point during the installation process. Thus, the legs 30 can be snap-fit into the glazing pocket 56 and the barbs 40 always firmly engage the walls 58,60 of the glazing pocket, notwithstanding minor variations in manufacturing tolerances which would advarsely impact the fit of metal legs.

Another feature of the disclosed embodiment is the pivotable attachment of the legs 30 to the filler plate 11. As the legs 30 are inserted into the glazing pocket 56 and the barbs 40 engage the glazing pocket walls 58,60, frictional engagement of the barbs with the channel walls exerts a rotational force about the socket 32 and flange 16. This moment causes the legs 30 to rotate outwardly, increasing the force exerted by the barbs 40 against the walls 58, 60 of the galzing pocket 56. Thus, the pivotable mounting of the legs 30 to the filler plate 11 causes the legs to bear even more firmly against the glazing pocket walls to increase the force exerted by the barbs 40 against the glazing pocket walls, thereby increasing the dependability of the fit.

Finally, it will be understood that the preferred embodiment has been disclosed by way of example, and that other modifications may occur to those skilled in the art without departing from the scope and spirit of the appended claims

We claim:

1. A snap-in glazing pocket filler for use with a structural frame member having walls defining a glazing pocket, comprising:

an elongated metal plate having a rear face and having a width sufficient to cover said glazing pocket, said elongated plate having a pair of flanges projecting rearwardly from said rear face thereof; and a pair of plastic retaining legs having corresponding snap-on sockets formed thereon for engaging said rearwardly projecting flanges on said rear face of said elongated plate to fasten said plastic retaining legs to said plate, said retaining legs extending rearwardly and outwardly of said plate to engage said walls defining said glazing pocket.

2. The apparatus of claim 1, wherein said snap-on sockets are configured to pivotably engage said rearwardly projecting flanges to pivotably fasten said plastic retaining legs to said plate.

3. The apparatus of claim 1, wherein said plastic retaining legs comprise rearwardly extending stems and flexible barbs projecting outwardly from said stems to engage said walls defining said glazing pocket.

4. The apparatus of claim 1, wherein said pair of plastic retaining legs are comprised of polyvinyl chloride.

5. The apparatus of claim 3, wherein said plastic retaining legs comprise rearwardly extending stems of rigid polyvinyl chloride and flexible barbs of flexible polyvinyl chloride or projecting outwardly from said stems to engage said walls defining said glazing pocket.

6. The apparatus of claim 5, wherein said flexible and rigid polyvinyl chloride stems and said flexible polyvinyl chloride barbs are coextruded.

7. An apparatus for use with a structural frame member having walls defining a glazing pocket, comprising:

an elongated metal plate having front and rear faces and having a width sufficient to cover said glazing pocket; and a pair of plastic retaining legs pivotably fastened to said elongated metal plate and extending rearwardly and outwardly thereof to engage said walls defining said glazing pocket.

8. The apparatus of claim 7, wherein said plastic retaining legs comprise rearwardly extending stems and flexible barbs projecting outwardly from said stems to engage said walls defining said galzing pocket.

9. The apparatus of claim 7, wherein said pair of plastic retaining legs are comprised of polyvinyl chloride.

10. The apparatus of claim 8, wherein said plastic retaining legs comprise rearwardly extending stems of rigid polyvinyl chloride and flexible barbs of flexible polyvinyl chloride projecting outwardly from said stems to engage said walls defining said glazing pocket.

11. The apparatus of claim 10, wherein said flexible and rigid polyvinyl chloride stems and said flexible polyvinyl chloride barbs are coextruded.

* * * * *